US009292001B2

(12) United States Patent
Fleury

(10) Patent No.: US 9,292,001 B2
(45) Date of Patent: Mar. 22, 2016

(54) JUMPER FOR CLOCKWORK MOVEMENT

(71) Applicant: ROLEX SA, Geneva (CH)

(72) Inventor: Christian Fleury, Challex (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/564,259

(22) Filed: Dec. 9, 2014

(65) Prior Publication Data

US 2015/0168915 A1 Jun. 18, 2015

(30) Foreign Application Priority Data

Dec. 13, 2013 (EP) ..... 13197199

(51) Int. Cl.
*G04B 11/00* (2006.01)
*G04B 19/24* (2006.01)

(52) U.S. Cl.
CPC ..... *G04B 11/008* (2013.01); *G04B 11/00* (2013.01); *G04B 19/24* (2013.01)

(58) Field of Classification Search
CPC .... G04B 11/00; G04B 19/253; G04B 11/022; G04B 11/028; G04B 11/04; G04B 11/008; G04B 19/24
See application file for complete search history.

(56) References Cited

U.S. PATENT DOCUMENTS

| | | | | |
|---|---|---|---|---|
| 3,482,391 | A | 12/1969 | Golen | |
| 7,158,448 | B1 | 1/2007 | Gabathuler et al. | |
| 7,218,576 | B1 | 5/2007 | Bron | |
| 2005/0254350 | A1* | 11/2005 | Fleury | 368/37 |
| 2005/0281136 | A1* | 12/2005 | Wilmouth et al. | 368/28 |
| 2010/0103780 | A1* | 4/2010 | Chaignat | 368/38 |
| 2010/0188937 | A1* | 7/2010 | Watanabe | 368/37 |
| 2012/0057434 | A1* | 3/2012 | Rudaz | 368/28 |
| 2014/0022872 | A1* | 1/2014 | Tran et al. | 368/37 |

FOREIGN PATENT DOCUMENTS

| | | | |
|---|---|---|---|
| CH | 338766 | A | 5/1959 |
| CH | 703 823 | A2 | 3/2012 |
| EP | 1 746 470 | A1 | 1/2007 |
| EP | 1 785 783 | A1 | 5/2007 |
| JP | 2004-184259 | A | 7/2004 |
| JP | 2008-197036 | A | 8/2008 |
| JP | 2012-189519 | A | 10/2012 |

OTHER PUBLICATIONS

European Search Report dated Jul. 28, 2014, issued in corresponding application No. EP 13 19 7199; with partial English translation and machine translation (14 pages).

* cited by examiner

*Primary Examiner* — Amy Cohen Johnson
*Assistant Examiner* — Matthew Powell
(74) *Attorney, Agent, or Firm* — Westerman, Hattori, Daniels & Adrian, LLP

(57) ABSTRACT

Jumper (201) comprising a jumper body (210), a jumper head (203), a first connecting element (292) connecting the jumper head to the jumper body, the first connecting element allowing the jumper head (203) to move relative to the jumper body (210), notably to rotate.

20 Claims, 10 Drawing Sheets

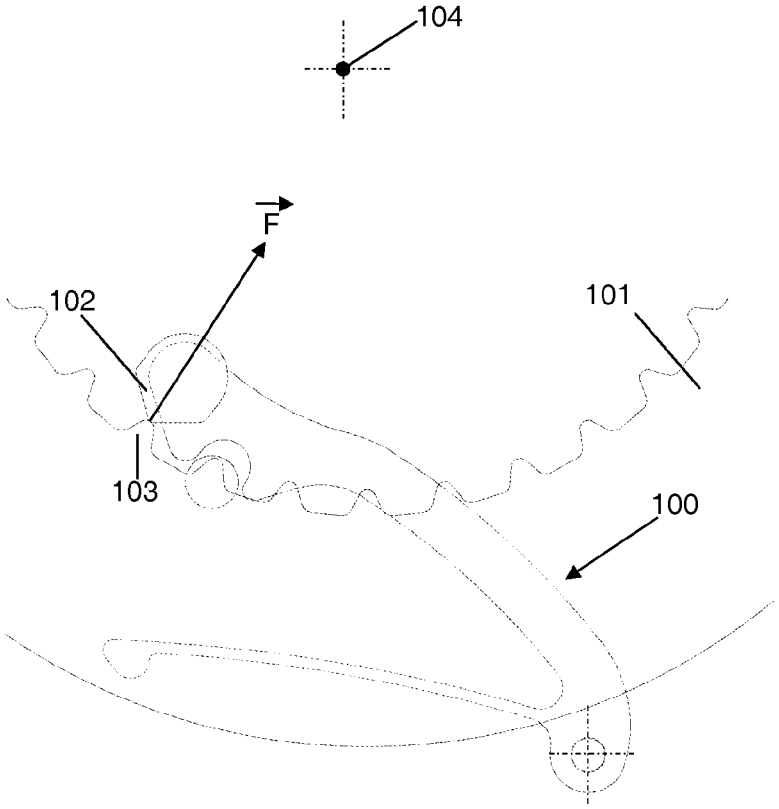
Figure 1 (state of the art)
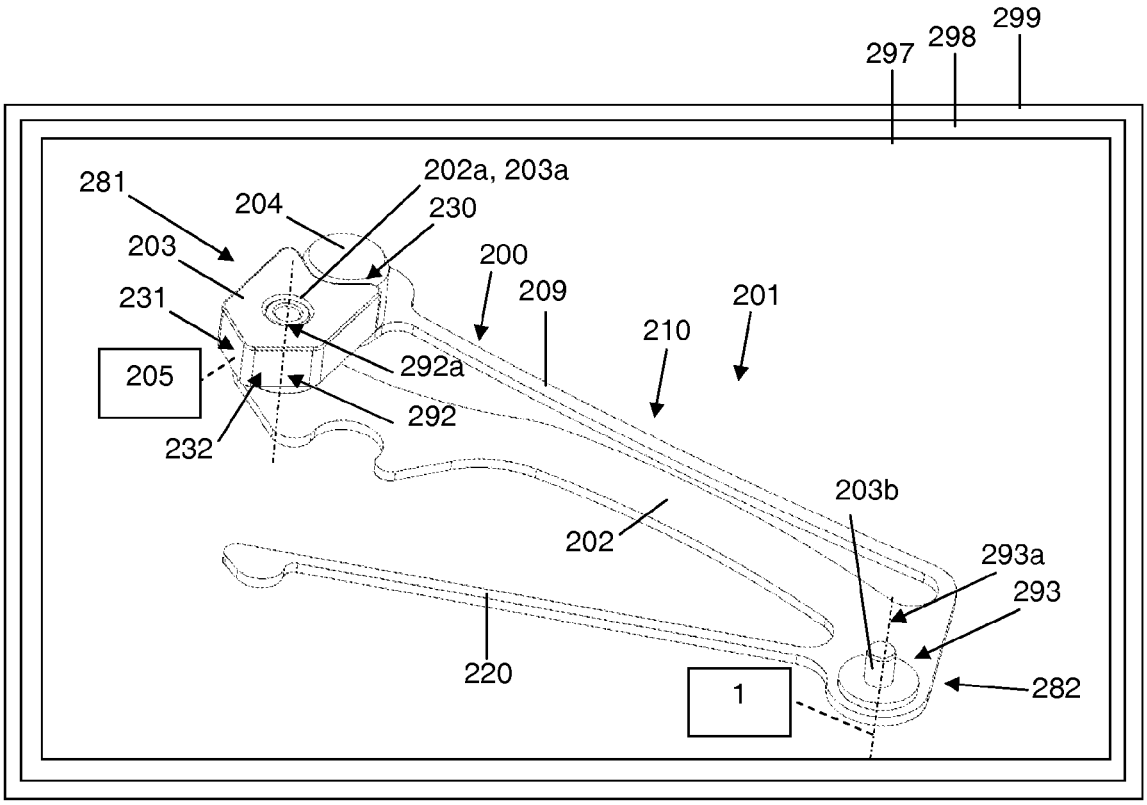
Figure 2

JUMPER FOR CLOCKWORK MOVEMENT

The invention relates to a jumper for a clockwork movement. The invention also relates to a clockwork mechanism comprising such a jumper. The invention further relates to a clockwork movement comprising such a mechanism or such a jumper. The invention further relates to a timepiece, notably a watch, comprising such a movement or such a mechanism or such a jumper.

Various jumper structures are known.

Document EP1746470 discloses a jumper that indexes a date disk which is made of a spring lever to which a beak is fixed at one of the ends of the lever. The spring lever is capable of rotational movement about an axis of pivoting situated at an opposite end from that of the beak and the latter cannot be moved relative to the spring lever.

With such a structure of jumper 100, as depicted in FIG. 1, when the date is being corrected manually there is a risk that the date disk 101 will become jammed between two dates as a result of a failure of the jumper beak 102, which may remain pressing in a stable manner against the top of one of the teeth of the disk, to return to a position of rest. What we mean by a position of rest of the jumper beak is a position in which the tooth set of the date disk is indexed, for example a position in which the jumper beak is arranged in the conventional way between two teeth of the date disk. This scenario is caused by the fact that the reaction force F of the top of the tooth on the end of the jumper beak may pass more or less through the axis 104 of pivoting of the date disk. In that configuration, the spring lever cannot restore the potential energy it has accumulated, and a problematic state of stable equilibrium then results because the disk or the member, that the jumper is supposed to index is not in a definite position, for example a definite date-indicating position.

Document EP1785783 discloses a jumper for indexing a date disk, the operation of which is similar to that of the abovementioned patent application. One difference stems from the architecture of the jumper which in this instance is a lever and a wire spring which is separate. The lever is able to rotate about an axis of pivoting situated at a first end of the lever, and a second end of the lever comprises a projection acting as a beak and which is pressed against the tooth set of the date disk under the effect of the wire spring. Such a construction is unable to remove the risk of the jumper beak failing to return to the rest position.

Document JP2004184259 discloses a construction within which the indexing jumper beak is capable of a translational movement. This configuration does nothing to remove the risk of the date disk becoming jammed between two disks as a result of just a single degree of freedom in the movement of the jumper beak.

Patent application JP2008197036 also describes a jumper capable of translational movement through the use of a flexible guidance. This architecture a priori makes it possible to obtain the same moments applied to the date disk whatever the direction in which it rotates, but does not make it possible to remove the range of rotation of the date disk in which the jumper beak and the date disk may find themselves in stable equilibrium.

In the light of this prior art, it would appear that known jumpers generally have a beak-shaped projection which presses against two consecutive teeth of a wheel under the effect of a first return spring. Thus, the wheel is kept precisely in a stable and determined angular position. When this wheel is rotationally driven through more than half an angular pitch, one of its teeth drives the jumper beak until the beak reaches the top of said tooth, then this beak is elastically returned against the successive tooth so that the wheel forms a full angular step and repositions itself in a stable angular position. This is notably the case with the date disk of a simple calendar which is driven on every day at midnight by a calendar runner configured to supply an impulse such that the jumper beak moves past the top of the tooth set and suitably repositions the date disk upon each jump. That may nonetheless be actuated indeterminately, for example via a manual date-correction mechanism which is capable of driving it by a value of the order of half an angular step. Such a configuration carries the risk of the date disk becoming jammed between two dates as a result of the failure of the jumper beak, which may remain pressing stably against the top of one of the teeth of the disk, to return to the rest position. This then results in a loss of calendar mechanism information and an unattractive look.

It is an object of the invention to provide a jumper that is able to overcome the disadvantages mentioned hereinabove and improve the jumpers known from the prior art. In particular, the invention proposes a jumper that minimizes the risks, or even that avoids the risks, of situations arising in which the member with which the jumper collaborates finds itself in an unforeseen and/or undesirable stable position.

A jumper according to the invention comprises a jumper body, a jumper head, a first connecting element connecting the jumper head to the jumper body, the first connecting element allowing the jumper head to move relative to the jumper body, notably to rotate.

Various aspects of the invention are as follows:

The jumper body comprises a second jumper body connecting element allowing the jumper body to move relative to a framework on which the jumper body is intended to be mounted, notably to rotate and/or to effect a translational movement.

The jumper body comprises a first return element for returning the jumper head to the first position relative to the jumper body, notably a first elastic element for returning the jumper head to the first position relative to the jumper body.

The first return element for returning the jumper head to the first position relative to the jumper body is designed to return the jumper head toward the first position in a first direction, the first position being defined by a first stop secured to the jumper body.

The first return element comprises a leaf spring secured to the jumper head, respectively secured to the jumper body, and collaborating by contact with a second stop provided on the jumper body or respectively on the jumper head.

The first return element for returning the jumper head to the first position is designed to return the jumper head toward the first position in a first direction and in a second direction.

The first return element comprises a cam flank, notably in the form of a vee, able to collaborate with a cam follower, notably a pin, the cam follower being returned against the cam flank by an elastic member.

The elastic member comprises an arm, the cam follower or the cam flank being provided on the arm, notably at one end of the arm.

The vee-shaped cam flank is produced on the jumper head, respectively on the jumper body, and the cam follower, notably the pin, is provided on the jumper body or, respectively, on the jumper head.

The first connecting element comprises an element, notably a pin on the jumper body, or respectively on the jumper head, collaborating with a bore on the jumper head or respectively the jumper body, producing a pivoting connection between the jumper head and the jumper body.

The first connecting element is a guide element which provides a pivoting connection between the jumper head and the jumper body.

The jumper comprises a second return element for returning the jumper body to a second position relative to the framework, notably a second elastic element for returning the jumper body to the second position relative to the framework.

A clock mechanism according to the invention comprises a jumper, which comprises a jumper body, a jumper head, a first connecting element connecting the jumper head to the jumper body, the first connecting element allowing the jumper head to move relative to the jumper body, notably to rotate; and a framework on which the jumper, particularly the jumper body, is mounted.

A clock movement according to the invention comprises a mechanism, the mechanism comprising a jumper, which comprises a jumper body, a jumper head, a first connecting element connecting the jumper head to the jumper body, the first connecting element allowing the jumper head to move relative to the jumper body, notably to rotate; and a framework on which the jumper, particularly the jumper body, is mounted.

A timepiece according to the invention comprises a jumper comprising a jumper body, a jumper head, a first connecting element connecting the jumper head to the jumper body, the first connecting element allowing the jumper head to move relative to the jumper body, notably to rotate.

The attached drawings depict, by way of examples, several embodiments of a jumper according to the invention.

FIG. 1 is a schematic view of a jumper known from the prior art.

FIGS. 2 to 11 are views of a first embodiment of a jumper according to the invention.

Figure 3:
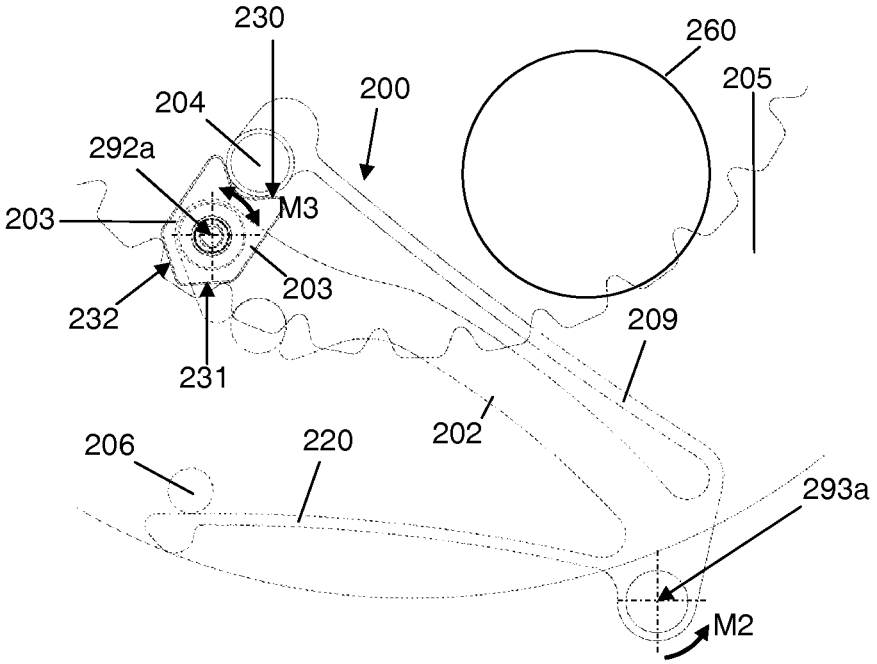

A first embodiment of a timepiece 299, notably a watch, particularly a wristwatch, is described hereinafter with reference to FIG. 2.

The timepiece comprises a clock movement 298.

The clock movement comprises a clock mechanism 297, for example a calendar mechanism.

The clock mechanism comprises a jumper 201 and a framework 1 on which the jumper, particularly a body 210 of the jumper, is mounted. The mechanism further comprises a wheel or a disk 205 collaborating with, the jumper and at least one drive device 260 driving the wheel or the disk, notably a wheel or disk drive device which is separate from the jumper. The drive device may for example take the form of a wheel or of a driving fingerpiece which is kinematically connected to the geartrain of a base movement. The drive device may also take the form of a correction mechanism, such as a correction wheel, or a yoke.

The jumper makes it possible for an element 205 such as a wheel or cam or even a display member, notably a member for displaying a parameter associated with time, such as a date disk, to be indexed in position, notably angularly in position.

As FIGS. 2 to 11 show, the first embodiment of the jumper 201 comprises the jumper body 210, a jumper head or beak 203, a first connecting element 292 connecting the jumper head to the jumper body. The first connecting element 292 allows the jumper head 203 to move relative to the jumper body 210. The movement may notably comprise a rotational movement, such as, for example, a movement made up of a rotational movement and a translational movement. In particular, the first connecting element may only allow a rotational movement as depicted in FIGS. 2 to 11.

The jumper body comprises a second connecting element 293 connecting the jumper body. The second connecting element 293 allows the jumper body 210 to move relative to the framework 1 on which the jumper body 210 is intended to be mounted. The movement may notably comprise a rotational movement and/or a translational movement such as, for example, a movement made up of a rotational movement and of a translational movement. In particular, the second connecting element may allow only a rotational movement as depicted in FIGS. 2 to 11.

A first element 200 for returning the jumper head to a first position is preferably designed to return the jumper head to the first position in a first direction and in a second direction, notably in the clockwise and counterclockwise directions indicated in the figures.

The jumper body delimited by a first end 281 and a second end 282, comprises, in this embodiment, mainly a main arm 202, a first auxiliary arm 209 and a second auxiliary arm 220.

For preference, the main arm is non-deformable or near non-deformable in conventional use of the jumper.

The first auxiliary arm 209 forms part of the first element 200 that returns the jumper head to a first position relative to the jumper body, particularly relative to the main arm. The first return element notably allows the jumper head to be returned elastically to the first position relative to the jumper body, particularly relative to the main arm. The first position is notably depicted in FIGS. 2, 3 and 9.

The first auxiliary arm and/or the first return element is, for example, a flexible arm formed as one with the rest of the body, notably with the main arm. The first auxiliary arm is, for example, connected to the rest of the body, notably to the main arm, toward the second end 282 of the body.

The second auxiliary arm 220 constitutes or forms part of a second return element 220 for returning the jumper body, particularly the main arm, to a second position relative to the framework. The second return element notably allows the jumper body, particularly the main arm, to be returned elastically to the second position relative to the framework. The second position is notably depicted in FIGS. 3 and 9. The second auxiliary arm and/or the second return element is, for example, a flexible arm formed as one with the rest of the body, notably with the main arm. The second auxiliary arm is, for example, connected to the rest of the body, notably to the main arm, toward the second end 282 of the body.

The second connecting element 293 preferably comprises a peg or a pin 203*b* or, respectively, a bore, provided on the jumper, notably toward the second end 282 of the body and intended to collaborate with a bore, or, respectively, with a peg or a pin, provided on the framework. Such a structure makes it possible to provide a pivot connection of the jumper on the framework about an axis. The second return element allows the jumper to be returned rotationally toward its second position about the pin 203*b*. To do this, the second auxiliary arm bears for example against an element 206, notably a stop, provided on the framework. In the second position, the first end 281 of the jumper is positioned in such a way that the head of the jumper engages in shapings 250 of the member 205 with which it is intended to collaborate. The second auxiliary arm is able to generate a resistive torque M2 relative to the pin 203*b* and thus allow the member to be held in its angular position as depicted in FIG. 3.

The first connecting element 292 preferably comprises a peg or a pin 202*a* secured to the jumper body, notably toward the first end 281 of the body, and which is designed to collaborate with a bore 203*a* formed on the jumper head. Thus, in the embodiment depicted in FIGS. 2 to 11, the structure makes it possible to achieve a pivot connection of the head on the jumper body about a pin 292*a*. The first return element allows the head to be returned rotationally toward its first position about the axis 292*a*.

The head comprises two flanks 231 and 232. These two flanks make an angle, notably an obtuse angle. The two flanks are intended to come into contact with the shapings, notably with the teeth, of the element 205, the position of which the jumper is intended to index.

The head also comprises a cam flank 230, notably a vee-shaped cam flank, able to collaborate with a cam follower such as a stud, a peg or more generally a pin 204, arranged on the first auxiliary arm 209, notably at the end of the first auxiliary arm. The cam follower is returned against the cam flank by an elastic member consisting of the first auxiliary arm 209.

Aside from the first auxiliary arm 209, the first return element 200 for returning the head comprises the pin 204 and the cam flank 230. Thus, the first return element is designed to generate a resistive torque M3 relative to the pin 292*a* and to keep the head in position in a determined angular position.

In the embodiment depicted, the elastic member comprises the first auxiliary arm 209 and the cam follower or the cam flank. Specifically, the cam follower may be provided on the first auxiliary arm, notably at one end of the first auxiliary arm, and the cam flank may be provided on the head. Alternatively, the cam flank may be provided on the first auxiliary arm, notably at one end of the first auxiliary arm, and the cam follower may be provided on the head.

The cam flank may be shaped as a vee.

Thus, the jumper 201 comprises a spring lever on which the jumper head is rotationally mounted.

In the first embodiment, the jumper head has a two-directional mode of operation. Thus, this head cancels the angular range of non-return of the jumper to the rest position whatever the direction of rotation of the element that the jumper is intended to index. Such a solution is particularly well suited to a date disk that can be moved in two directions of correction.

The case of rotation of the element 205 in the clockwise direction will be considered hereinafter.

Figure 4:
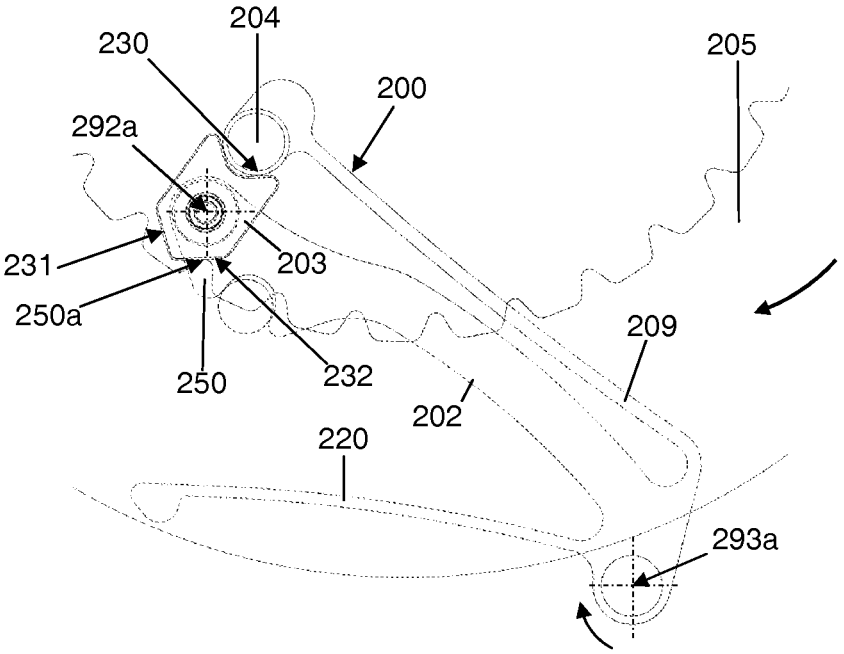

In a first phase of driving of the element 205 as indicated in FIG. 4, when this element is driven over an angular range from 0° to a value of the order of one quarter of the angular pitch, the head is rotationally driven in the clockwise direction only about the pin 293*a* under the action of one flank 250*a* of a tooth 250 of the element 205 on the flank 232 of the head. The jumper body is thus moved away from the second position against the action of the second return element. Alternatively, the jumper head can first of all be rotationally driven in a first direction of rotation only about the pin 292*a* as soon as a tooth 250 drives the jumper head.

Figure 5:
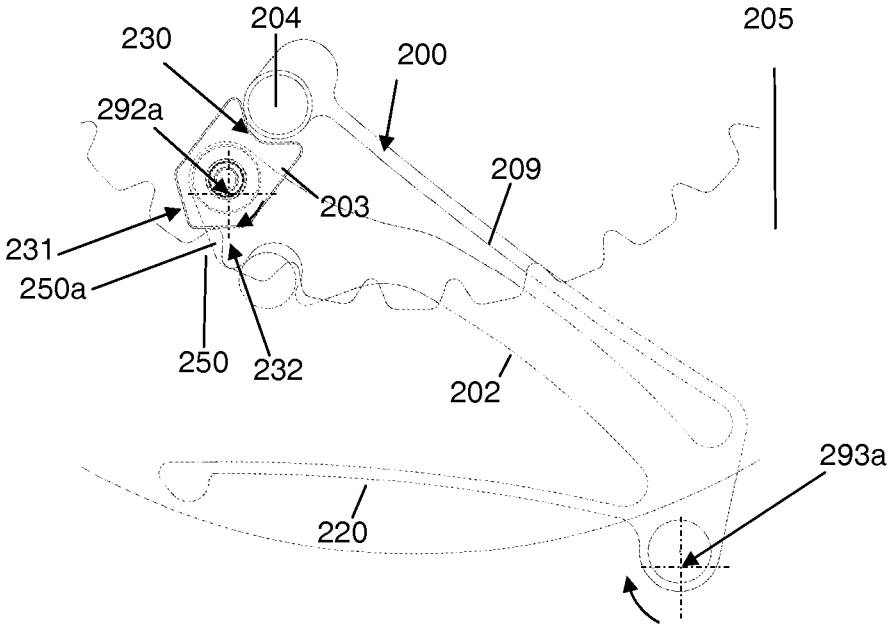
Figure 6:
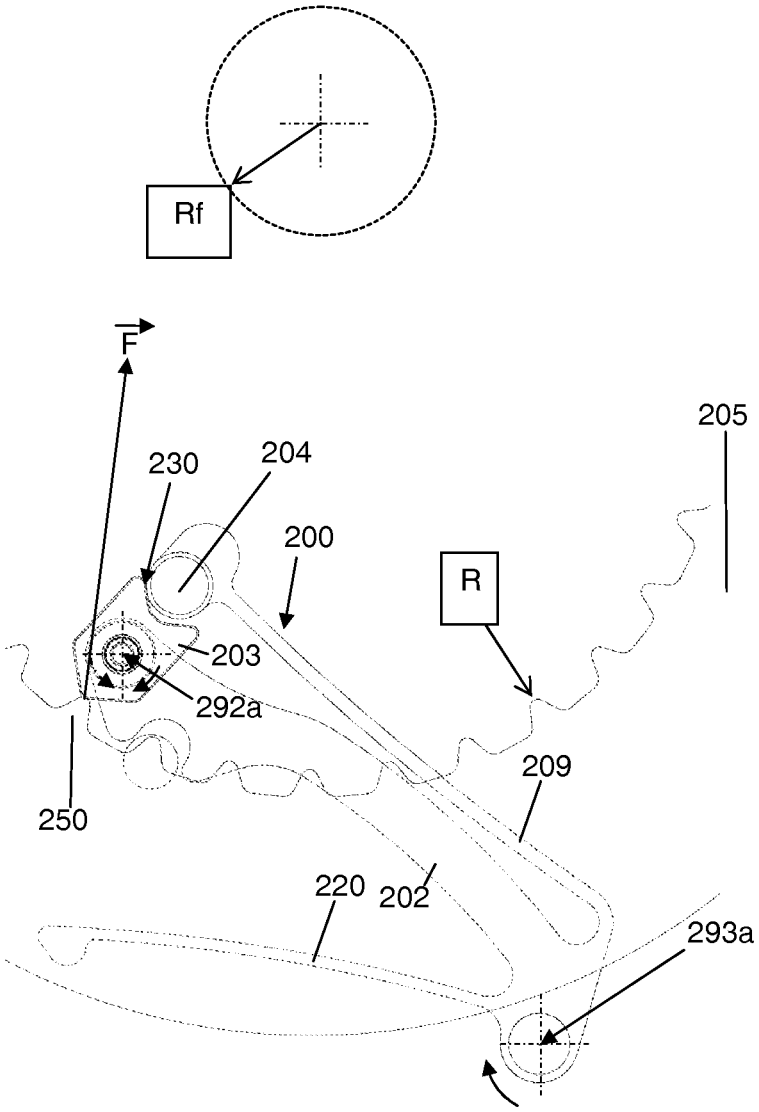

In a second phase of driving of the element 205 as depicted in FIG. 5, when this element is driven over an angular range by a value of the order of one quarter of the angular pitch to a value of the order of half an angular pitch, the head is likewise rotationally driven by contact of the tooth 250 with the flank 232 in the clockwise direction about the pin 293*a* so that its flank 230 arms the first auxiliary arm 209 via the cam follower 204. The head is thus moved away from the first position against the action of the first return element. Thus, when the head 203 reaches the top of the tooth as depicted in FIG. 6, this head is oriented relative to the tooth 250 in such a way that the reaction force of the top of the tooth on the jumper head is not directed toward the axis of pivoting of the element 205. More specifically, the reaction force F does not pass through the circle, the radius Rf of which is defined by the radius of guidance R of the element 205 and by the coefficient of friction between the date disk and the guide surface thereof, more particularly by the product of the guidance radius R and the sine of the arctangent of the coefficient of friction between the date disk and the guide surface thereof. Moreover, the position of the head relative to the pin 293*a* is unstable, which means that the passage from one flank of the tooth to the other occurs instantly as a result of the energy stored in the first elastic auxiliary arm 209 which is released.

Figure 7:
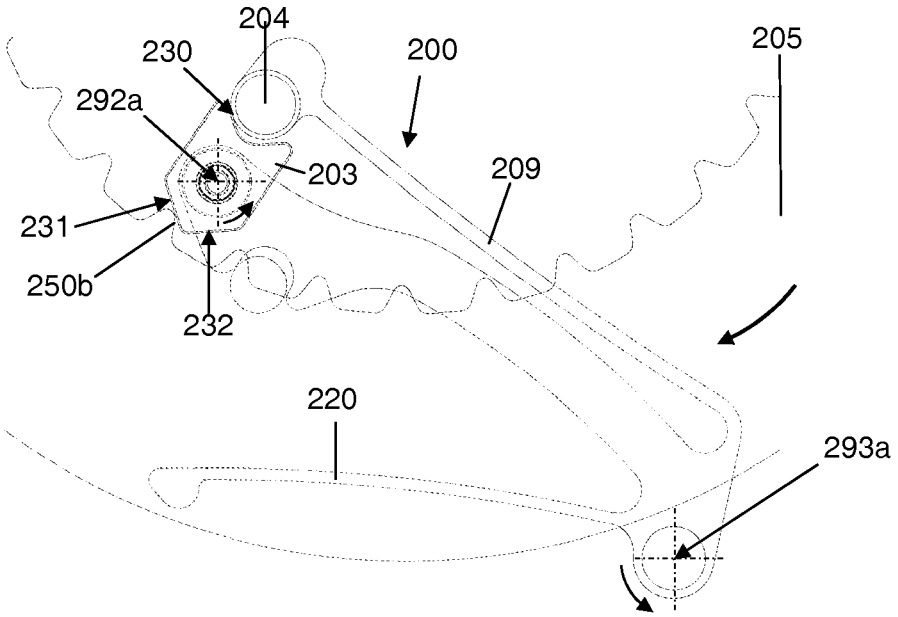
Figure 8:
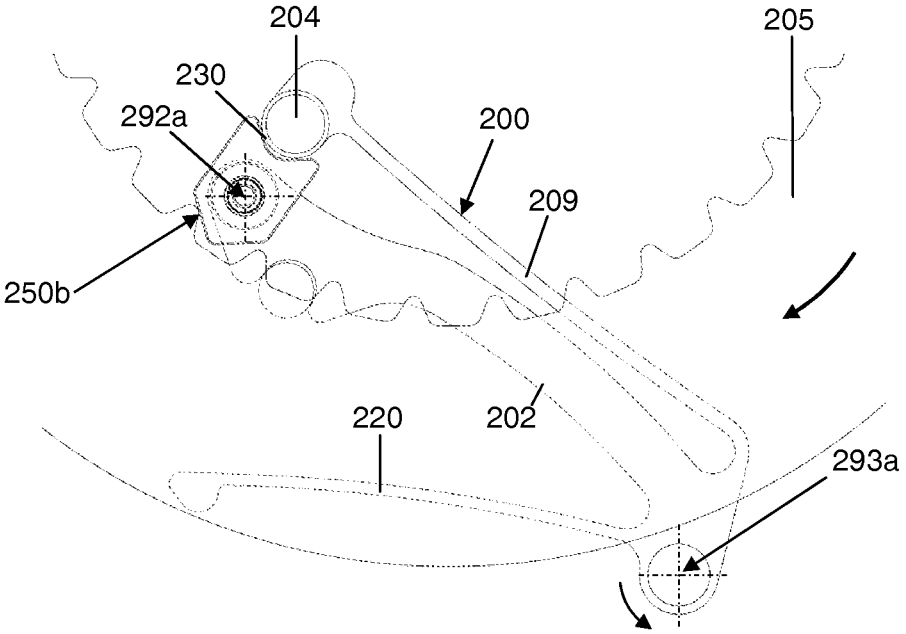

In a third phase of the driving of the element 205 as depicted in FIG. 7, restoring or returning the first elastic auxiliary arm 209 to the rest position causes the head 203 to rotate in the counterclockwise direction about the pin 293*a*, allowing it to overcome the top of the tooth 250. The flank 231 of the head therefore drives a flank of the tooth 250 of the element 205. In that configuration, the head is able to rotate about the pins 292*a* and 293*a* in the counterclockwise direction.

Figure 9:
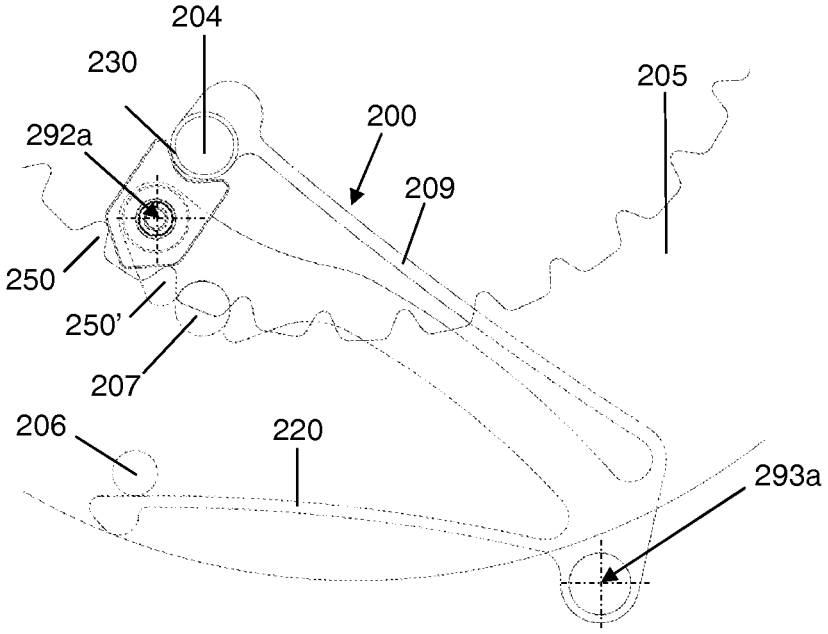

In a fourth phase of the driving of the element 205 as indicated in FIG. 8, the head is once again in a stable position relative to the pin 292*a*. It is again able to move rotationally only about the pin 293*a* until such time as the body of the jumper comes against a stop 207 or as the flanks 231 and 232 of the head come against the respective flanks of the teeth 250 as depicted in FIG. 9.

Figure 10:
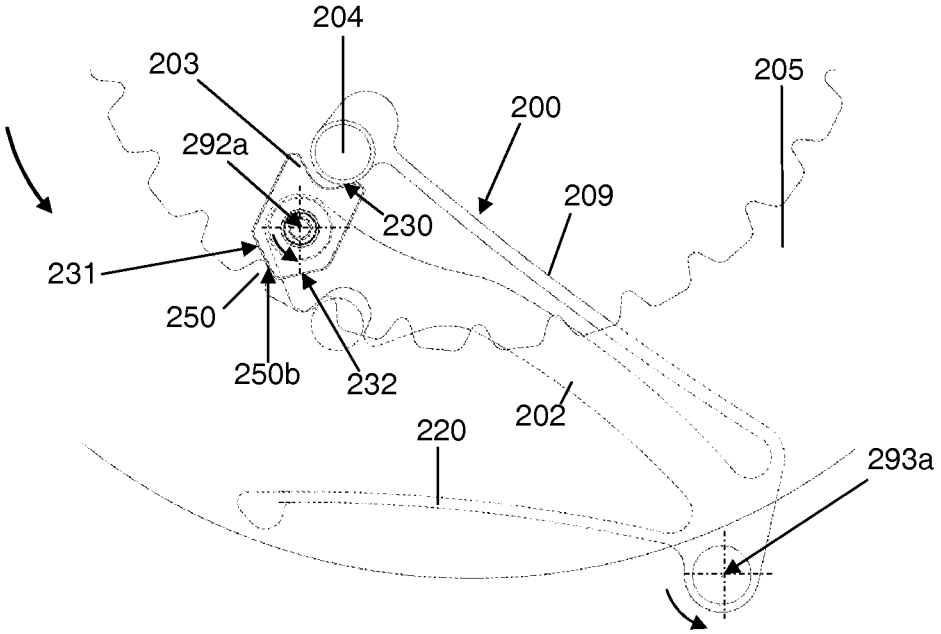

The principle of operation of the jumper is the same for a rotation of the element 205 in the counterclockwise direction, the flank 230 of the head 203 also being shaped to arm the first elastic auxiliary arm 209 via the peg 204 when the head rotates in the counterclockwise direction as indicated in FIG. 10. The actions of the flanks 231 and 232 are then reversed.

Alternatively, this jumper, notably the jumper head, may adopt a mode of operation that can be broken down more simply into two or three distinct phases of rotation of the element 205. The head may thus be rotationally driven in a first direction of rotation respectively relative to the pins 292*a* and 293*a* as soon as a tooth of the element 205 drives the head, and until the latter more or less reaches the top of said tooth. The head may then be rotationally driven in a second direction of rotation respectively relative to the pins 292*a* and 293*a* as soon as the head moves past the top of the tip of the tooth of the element 205, and until such point as the jumper reaches its rest position.

Figure 11:
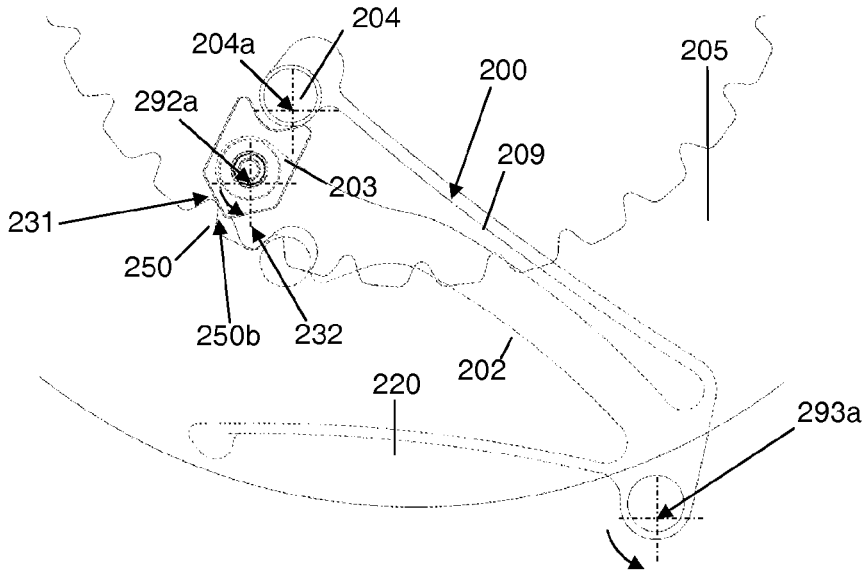

Optionally, as an alternative, the peg 204 may be capable of rotating about a third axis of rotation 204*a*, as depicted in FIG. 11. Thus, in this situation, the peg may roll along the cam flank rather than sliding against that flank.

A second embodiment of a timepiece 399, notably a watch, particularly a wristwatch, is described hereinafter with reference to FIG. 12.

The timepiece comprises a clock movement 398.

The clock movement comprises a clock mechanism 397, for example a calendar mechanism.

The clock mechanism comprises a jumper 301 and a framework 1 on which the jumper, particularly a jumper body 310, is mounted. The mechanism further comprises a wheel or disk 305 collaborating with the jumper and a drive device 360 driving the wheel or the disk, notably a wheel or disk drive device which is separate from the jumper. The drive device may, for example, take the form of a driving fingerpiece or wheel which is kinematically connected to the geartrain of a base movement. The drive device may also take the form of a correction mechanism, such as a correction wheel or a yoke.

The jumper allows an element 305 such as a wheel or a cam or even a display member, notably a member displaying a parameter associated with time, such as a date disk, to be indexed in position, notably angularly in position.

As FIGS. 12 to 17 depict, the second embodiment of the jumper 301 comprises the jumper body 310, a jumper head 303 or jumper beak, a first connecting element 392 connecting the jumper head to the jumper body. The first connecting element 392 allows the jumper head 303 to move relative to the jumper body 310. The movement may notably comprise a rotational movement such as, for example, a movement made up of a rotational movement and of a translational movement. In particular, the first connecting element may allow only a rotational movement as depicted in FIGS. 12 to 17.

An element from the first embodiment and an element from the second embodiment which have identical or similar functions bear references that have the same digits for the tens and the units. The hundreds digit is a "2" for the reference of the element of the first embodiment and the hundreds digit is a "3" for the reference of the element of the second embodiment.

The second embodiment chiefly differs from the first embodiment in that the first return element for returning the jumper head to the first position relative to the jumper body is designed to return the jumper head to the first position in a first direction, the first position being defined by a first stop 350 secured to the jumper body.

Advantageously, the first return element comprises a leaf spring 300 secured to the jumper head or respectively secured to the jumper body and collaborating through contact with a second stop 350 provided on the jumper body or on the jumper head, respectively.

Figure 12:
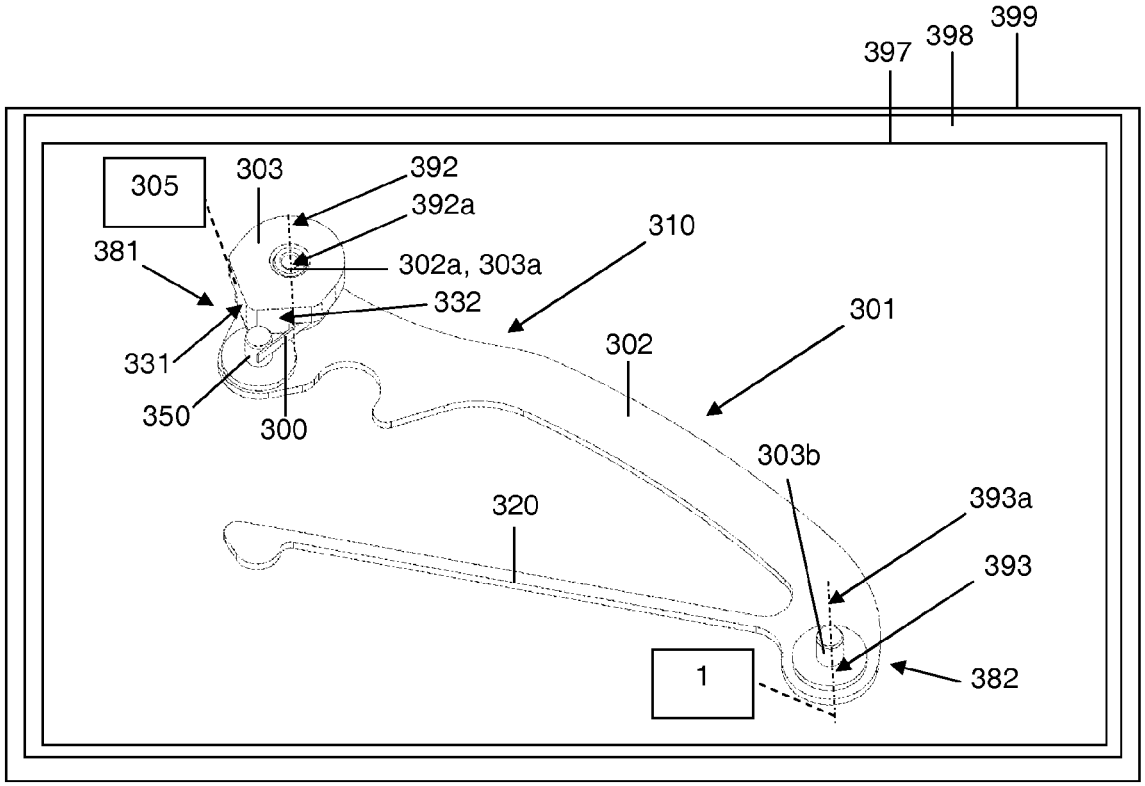
FIGS. 12 to 17 are views of a second embodiment of a jumper according to the invention.
Figure 13:
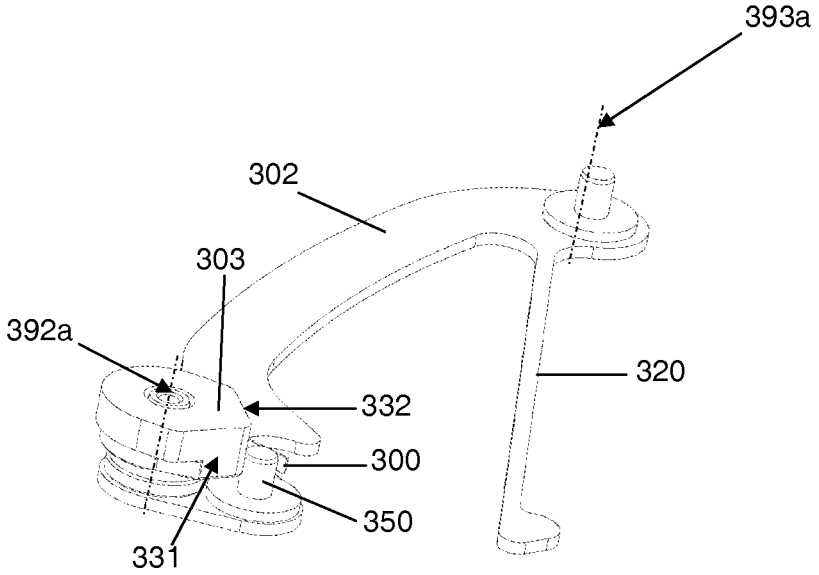

In the second embodiment as depicted in FIGS. 12 and 13, the first and second stops are embodied by one and the same stop. The jumper head has a one-way mode of operation so as to eliminate the range of nonreturn of the jumper to the rest position in just one direction of rotation of the element 305 with which it collaborates. The jumper allows this element 305 to be indexed in terms of position.

Unlike in the first embodiment, the jumper does not have a first auxiliary arm. As was seen above, the first return element returning the jumper head to the first position relative to the jumper body here comprises a leaf spring 300 or a spring. This spring is, for example, secured to the head 303 by welding. This spring is pre-armed by a stop or a peg 350 attached to the main arm 302. The spring in fact bears against the stop. The stop 350 also allows the head to be halted in a predetermined position that corresponds to the position of abutment of the head against the stop. There may of course be two stops, one for the spring to rest against and one for halting the head in a pre-determined position.

Figure 15:
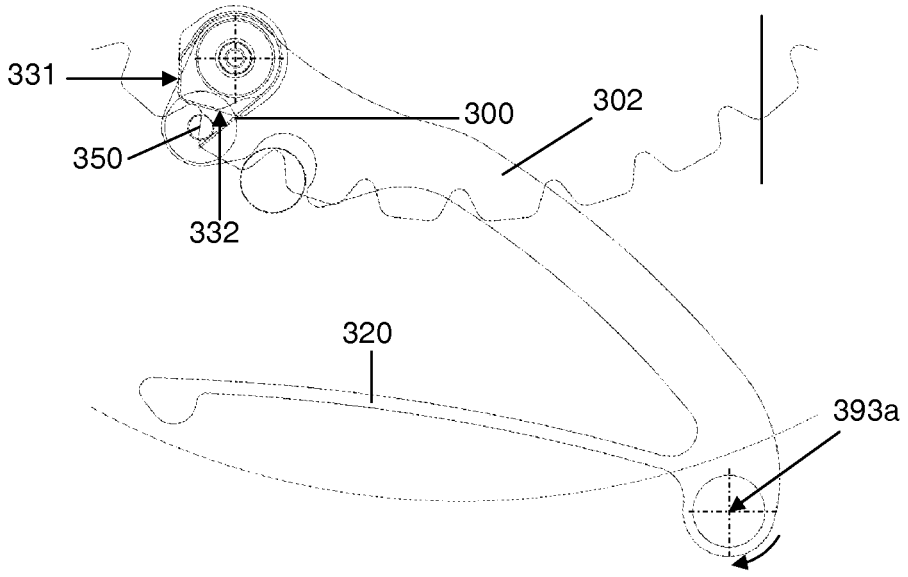
Figure 17:
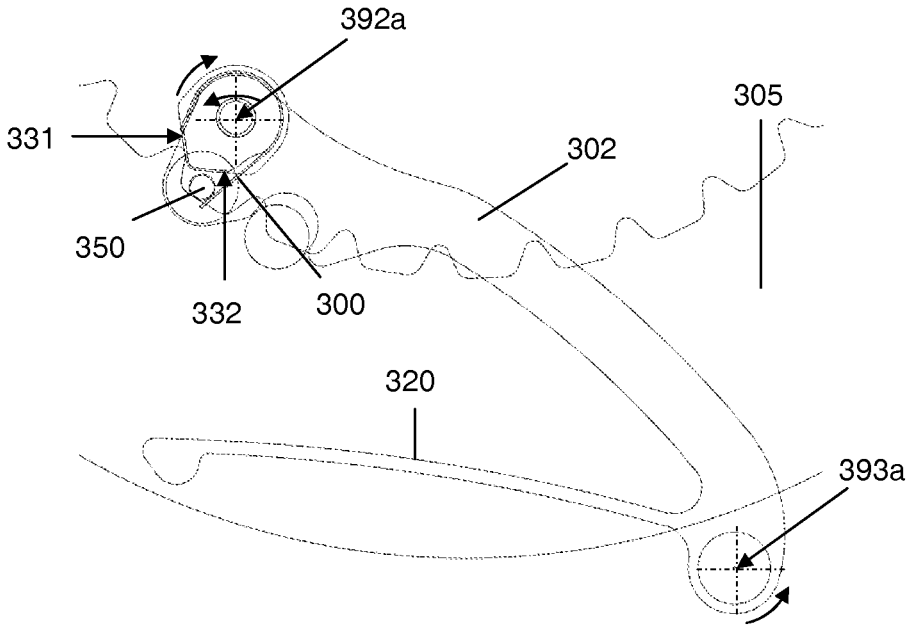

For a single direction of rotation of the element 305, for example a rotation in the clockwise direction as depicted in FIGS. 15 and 17, the principle of operation of this jumper is identical to that of the first embodiment. This jumper also has a mode of operation which can be broken down into two, three or four phases of rotation of the date disk.

Figure 14:
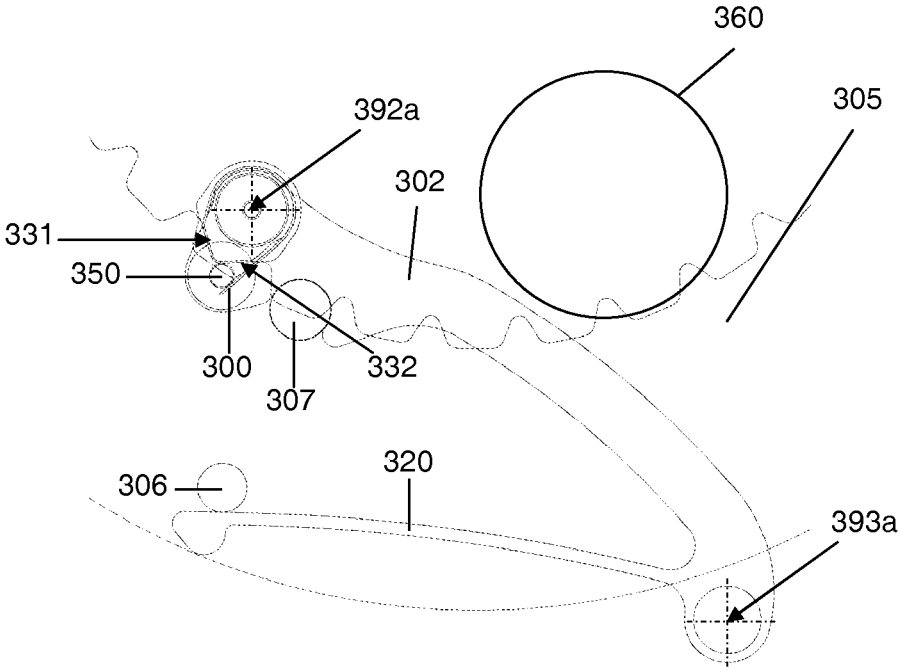
Figure 16:
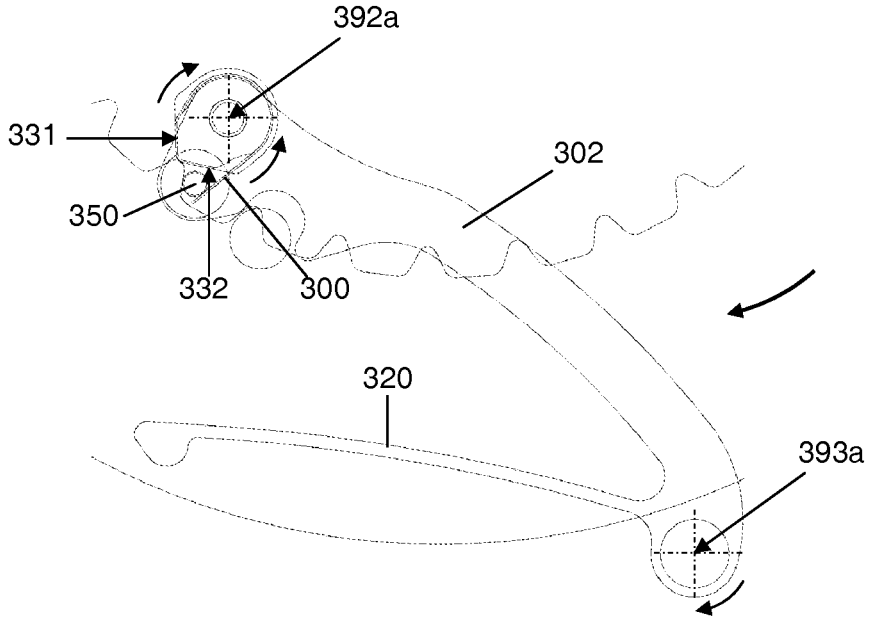

FIG. 14 illustrates the jumper at rest. FIG. 15 depicts the rotation of the head in the clockwise direction respectively relative to the pins 392*a* and 393*a* under the actuation of the flank 350*a* of the tooth 350. FIG. 16 depicts the head positioned more or less at the top of the tooth. Its positioning is therefore unstable because of the effect of the spring 300. FIG. 17 illustrates the head once it has overcome the top of the tooth; it then becomes capable of rotating in the counterclockwise direction respectively relative to the pins 292*a* and 293*a*.

In an alternative embodiment, the jumper body may be capable of translational movement along an axis substantially parallel to the plane of the framework of the mechanism or of the clock movement. As in the first and second embodiments, the head of the jumper may have a one-way or two-way mode of operation.

Thus, in the various embodiments, the jumper makes it possible to avoid the risk of situations occurring in which the jumper head finds itself in an unplanned and/or undesirable stable situation by:

- A jumper head that is able to move relative to the jumper body.
- More particularly, a jumper head capable of rotational movement about a pin 292*a*, 392*a* in two directions of rotation, over an angular pitch of the element with which it collaborates.
- A jumper head positioned stably by a return element. The switch from one flank of a tooth to another takes place instantaneously thanks to the energy stored up in the return element.
- For preference, the pins 292*a* and 392*a* are positioned on the bisector of the angle formed by a first half straight line having as its origin the axis of pivoting of the element 205, 305 and passing through the top of a first tooth, and by a second half straight line having as its origin the axis of pivoting of the element 205, 305 and passing through the top of a tooth consecutive to the first tooth, when the element 205, 305 is at rest.
- For preference, the jumper head is also capable of rotating about a second pin 293*a*, 393*a*.
- Advantageously, a resistive torque M3 relative to the pin 292*a*, 392*a* is greater than the resistive torque M2 relative to the pin 293*a*, 393*a* produced by the first return element 220, 320 over a first phase of rotation of the date disk.

In the various embodiments described hereinabove, the first connecting element is preferably a guide element which performs a pivot connection between the jumper head and the jumper body.

In the various embodiments described hereinabove, the first return element and/or the second return element may take the form of flexible articulations or guides.

A jumper according to the invention makes it possible to minimize the risks, or even to avoid the risks, of situations occurring in which the jumper finds itself in a position of equilibrium when not in a position of rest.

In the various embodiments described hereinabove, the jumper may form part of a clock mechanism notably a calendar mechanism. The jumper collaborates with a wheel or disk, particularly collaborates through contact with a wheel or a disk, notably collaborates through contact with a tooth set of a wheel or of a disk. The jumper thus allows the position of the wheel or of the disk to be indexed. The wheel or the disk, more generally the mechanism, can be actuated through a drive device 260, 360 distinct from the jumper. The drive device may for example take the form of a drive wheel kinematically linked to the geartrain of a base movement. The drive device may equally take the form of a correction mechanism, such as a correction wheel or a yoke.

More particularly, the disk may be a calendar disk that can be rotationally driven via its tooth set by the drive device.

The head of the jumper is in permanent contact with the wheel or the disk, the position of which it indexes, and is notably in permanent contact with a tooth set of the wheel or the disk. This is particularly the case where the wheel or the disk is not actuated by the drive device.

The jumper head is returned by a first elastic return element against the wheel or the disk. Thus, the restitution of the mechanical energy of the return element may contribute to the driving of the wheel or the disk.

More particularly, the jumper head is arranged in such a way that the reaction force produced between it and the tooth set of the disk or of the wheel that is to be indexed is oriented in such a way as to prevent the jumper head from sticking at the top of a tooth of the wheel or of the disk or prevent there being a position of equilibrium of the jumper head at the top of a tooth of the wheel or of the disk, notably when the wheel or the disk is actuated by a drive device.

In this document, the term "jumper" means a member ending with a head provided with two inclined planes which, by elastic return, press between the tops and/or the flanks of two consecutive teeth of a wheel in order to keep it in a certain position. When the wheel is moved, under the effect of a drive member distinct from the jumper, a tooth lifts the jumper by action on the jumper head. The jumper, particularly the jumper head, then drops down between the tooth that lifted it and a following tooth.

The invention claimed is:

1. A jumper comprising;

a jumper body, a jumper head, a first connecting element connecting the jumper head to the jumper body, the first connecting element allowing the jumper head to move relative to the jumper body, a second jumper body connecting element allowing the jumper body to move relative to a framework on which the jumper body is intended to be mounted, wherein a movement of the jumper head is subject to a first resistive torque with respect to the first connecting element and the second resistive torque with respect to the second jumper body connecting element.

2. The jumper as claimed in claim 1, wherein the second jumper body connecting element allows the jumper body to effect at least one of (i) rotation movement and (ii) translation movement relative to the framework on which the jumper body is intended to be mounted.

3. The jumper as claimed in claim 1, and which comprises a first return element for returning the jumper head to a first position relative to the jumper body.

4. The jumper as claimed in claim 3, wherein the first return element for returning the jumper head to the first position relative to the jumper body is adapted to return the jumper head toward the first position in a first direction, the first position being defined by a first stop secured to the jumper body.

5. The jumper as claimed in claim 4, wherein the first return element comprises a leaf spring secured to the jumper head, or respectively secured to the jumper body, and the leaf spring collaborating by contact with a second stop provided on the jumper body or respectively on the jumper head.

6. The jumper as claimed in claim 3, wherein the first return element for returning the jumper head to the first position is adapted to return the jumper head toward the first position in a first direction and in a second direction.

7. The jumper as claimed in claim 3, wherein the jumper comprises:

a cam follower, and an elastic member, and wherein the first return element comprises a cam flank able to collaborate with the cam follower, the cam follower being returned against the cam flank by the elastic member.

8. The jumper as claimed in claim 7, wherein the elastic member comprises an arm, the cam follower or the cam flank being provided on the arm.

9. The jumper as claimed in claim 7, wherein the cam flank is provided on the jumper head, or respectively on the jumper body, and wherein the cam follower is provided on the jumper body or, respectively, on the jumper head.

10. The jumper as claimed in claim 1, wherein the first connecting element comprises an element on the jumper body, or respectively on the jumper head, collaborating with a bore on the jumper head or respectively the jumper body, and providing a pivoting connection between the jumper head and the jumper body.

11. The jumper as claimed in claim 1, wherein the first connecting element is a guide element which provides a pivoting connection between the jumper head and the jumper body.

12. The jumper as claimed in claim 1, wherein the jumper comprises a second return element for returning the jumper body to a second position relative to the framework.

13. A clock mechanism, comprising;

a jumper as claimed in claim 1 and a framework on which the jumper is mounted.

14. The clockwork mechanism as claimed in claim 13, comprising;

a wheel or disk collaborating with the jumper and a drive device for driving the wheel or the disk.

15. A clockwork movement comprising a clock mechanism as claimed in claim 13.

16. A timepiece, comprising a clock mechanism as claimed in claim 13.

17. A clockwork movement comprising a jumper as claimed in claim 1.

18. A timepiece, comprising a clockwork movement as claimed in claim 17.

19. A timepiece, comprising a jumper as claimed in claim 1.

20. A jumper comprising:

a jumper body comprising a main arm, a jumper head, a first connecting element connecting the jumper head to the jumper body, the first connecting element allowing the jumper head to move relative to the jumper body, a first return element adapted to cooperate with the jumper head, and a second return element connected to the main arm, wherein the first return element elastically returns the jumper head to a first predetermined position relative to the jumper body, and wherein the second return element elastically returns the main arm to a second predetermined position relative to the second return element.

* * * * *